US008225553B1

(12) United States Patent
Redfern et al.

(10) Patent No.: US 8,225,553 B1
(45) Date of Patent: Jul. 24, 2012

(54) FIREZONE FUMETIGHT SEAL

(75) Inventors: Robert Redfern, Media, PA (US); Patrick Arthur Ryals, Chesapeake, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 500 days.

(21) Appl. No.: 11/543,281

(22) Filed: Sep. 28, 2006

(51) Int. Cl.
*E06B 7/18* (2006.01)

(52) U.S. Cl. ..... 49/477.1; 49/479.1; 49/489.1; 49/506; 49/498.1

(58) Field of Classification Search ..... 49/475.1, 49/477.1, 489.1, 506
See application file for complete search history.

(56) References Cited

U.S. PATENT DOCUMENTS

| | | | | |
|---|---|---|---|---|
| 3,566,541 | A * | 3/1971 | Coulter | 49/475.1 |
| 3,955,330 | A * | 5/1976 | Wendt | 52/211 |
| 4,603,524 | A * | 8/1986 | Mann | 52/232 |
| 4,649,089 | A * | 3/1987 | Thwaites | 52/1 |
| 4,658,548 | A * | 4/1987 | Gerritsen | 49/498.1 |
| 5,216,840 | A | 6/1993 | Andrews | |
| 5,279,087 | A * | 1/1994 | Mann | 52/232 |
| 5,553,871 | A | 9/1996 | Rowe et al. | |
| 6,327,826 | B1 * | 12/2001 | Mann | 52/204.1 |
| 6,572,948 | B1 | 6/2003 | Dykhoff | |
| 6,799,396 | B1 | 10/2004 | Redfern et al. | |
| 6,879,256 | B1 | 4/2005 | Redfern et al. | |
| 7,451,714 | B1 * | 11/2008 | Redfern et al. | 114/117 |
| 2002/0113377 | A1 * | 8/2002 | Mann | 277/628 |
| 2003/0024184 | A1 * | 2/2003 | Orr et al. | 52/211 |

FOREIGN PATENT DOCUMENTS

| | | | |
|---|---|---|---|
| GB | 2070114 A | * | 9/1981 |
| GB | 2165876 A | * | 4/1986 |
| GB | 2212539 A | * | 7/1989 |
| GB | 2268533 A | * | 1/1994 |
| GB | 2330855 A | * | 5/1999 |
| WO | WO 9922107 A1 | * | 5/1999 |

* cited by examiner

*Primary Examiner* — Jerry Redman
(74) *Attorney, Agent, or Firm* — Dave A. Ghatt

(57) ABSTRACT

A method and apparatus for fireproofing a doorway, more particularly, the present invention relates to a gasket structure capable of sealing a doorway in the event of a fire. The gasket structure includes an outer silicon rubber core having a substantially D-shaped cross-section for mounting to a gasket retainer with a substantially U-shaped channel to a door frame. The gasket also includes an inner core of intumescent material within the outer core. The gasket is designed so that if the outer silicone rubber deteriorates because of fire, the intumescent material undergoes voluminous expansion to fill up voids left by the deterioration of the outer silicone rubber.

14 Claims, 3 Drawing Sheets

FIG. 1A
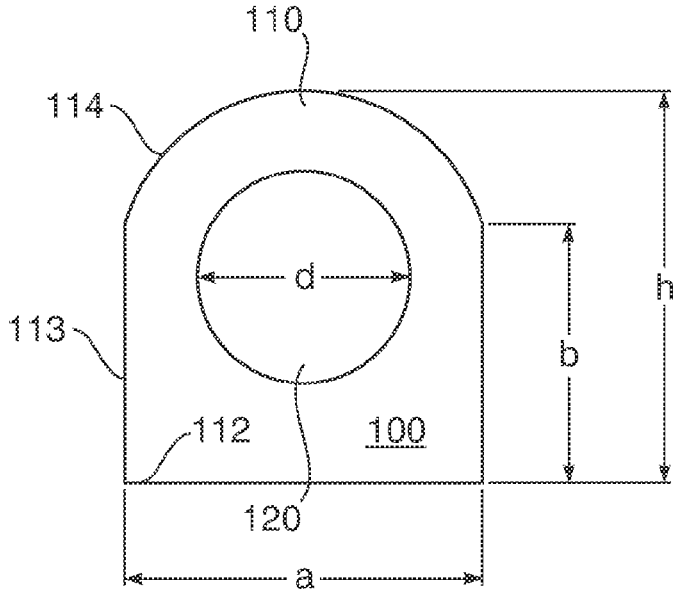
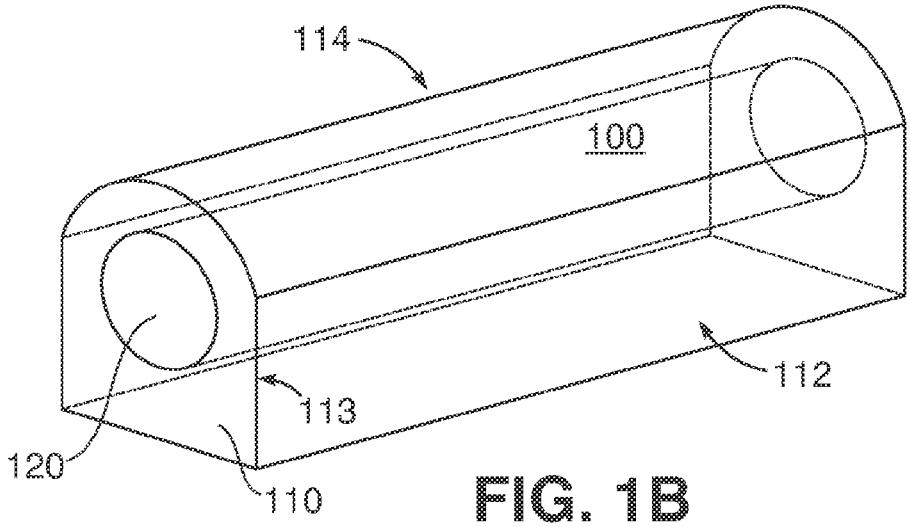
FIG. 1B

FIG. 2A
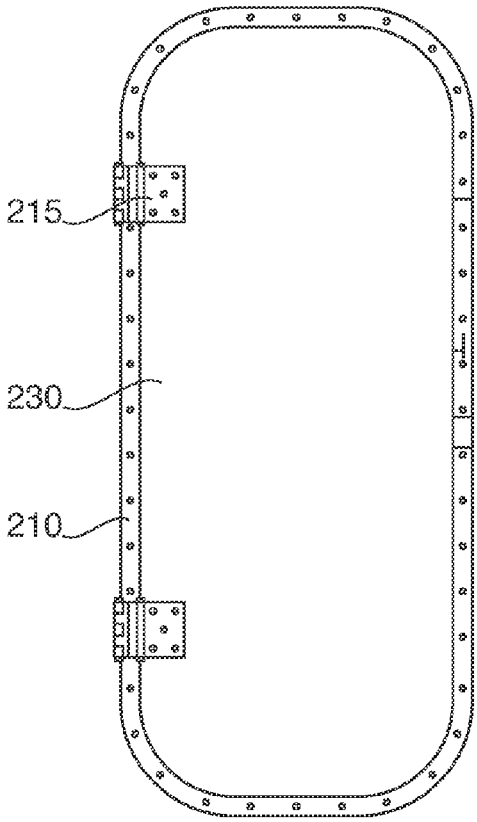
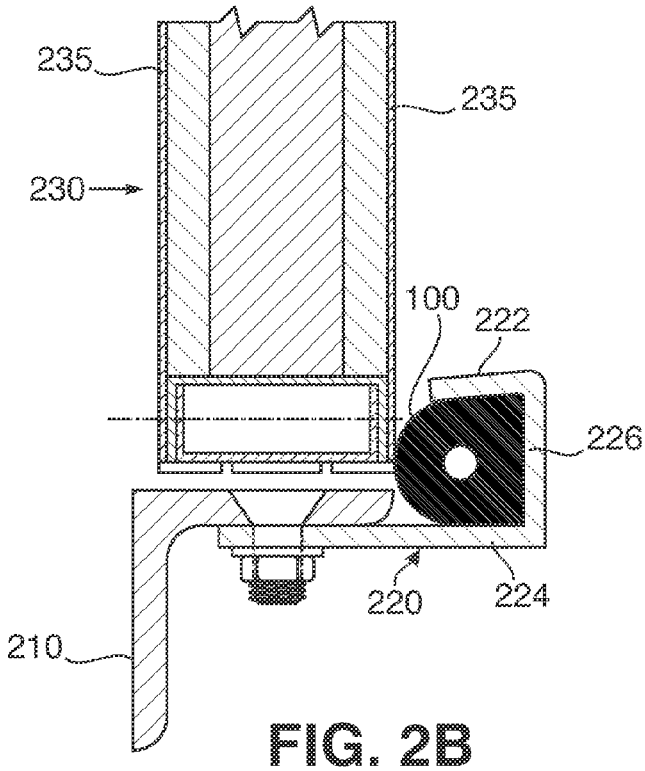
FIG. 2B

FIREZONE FUMETIGHT SEAL

STATEMENT OF GOVERNMENT INTEREST

The invention described herein may be manufactured and used by or for the Government of the United States of America for governmental purposes without the payment of any royalties thereon or therefore.

FIELD OF THE INVENTION

The present invention relates generally to a method and apparatus for fireproofing a doorway, more particularly, the present invention relates to a gasket structure capable of sealing a doorway in the event of a fire.

BACKGROUND OF THE INVENTION

U.S. Navy fire zone doors are utilized in fire zone boundaries where egress through bulkheads is needed but watertight integrity is not required. These doors must be as close to fume-tight as possible. Typically the doors are formed from a hollow panel filled with a heat insulating material that reduces heat transfer from one side of the door panel to the other during a fire. Gaskets are typically used around the opening of the door, in order to approach a fume-tight status.

Current methods used to prevent the spread of fire and the passage of smoke through doorways include the use of gaskets that have a core made of silicone rubber, covered with a stainless steel wire reinforced fiberglass yarn that is overcoated with silicone rubber. The gasket is attached to a gasket retainer. This prior art gasket tends to be very rigid and difficult to install due to irregularities that typically exist in the bulkhead in which the frame is installed. Often it is difficult to obtain a continuous seal around the perimeter of the door opening, thus defeating the purpose of obtaining a fume-tight seal.

A softer less rigid gasket would improve the ability to seal the doorway, compensating for any irregularities in the bulkhead in which the fire zone doors are installed. As outlined in U.S. Pat. No. 5,553,871, a softer rubber, the type ZZ-R-765 gasket was developed for providing a watertight seal. Softer rubber based products, as taught in U.S. Pat. No. 5,553,871, would allow for easier installation, however softer rubber based products are not suited to withstand the temperature requirements in working conditions for prolonged periods of time. Consequently, there is a need for a more pliable gasket arrangement that could withstand the rigors associated with a fire.

SUMMARY OF THE INVENTION

The present invention addresses aspects of problems outlined above. Preferred embodiments of the present invention provide a method and apparatus for sealing a doorway.

In one aspect, the invention is a fumetight gasket for use in a doorway. In this aspect, the gasket comprises an elongated member having a substantially D-shaped cross-section for mounting to a substantially U-shaped gasket retainer in a door frame. The elongated member has a substantially D-shaped outer core that comprises silicone rubber. The fumetight gasket also includes an inner core within the substantially D-shaped outer core. In this aspect, the inner core comprises an intumescent material for filling doorway voids during fires when the inner core is exposed by the deterioration of the outer core.

In another aspect, the invention is a fire zone doorway arrangement. The arrangement includes a door frame and a gasket retainer attached to the door frame. In this aspect, the gasket retainer has a substantially U-shaped channel with a back wall and two oppositely situated side walls. The arrangement further includes a gasket having an elongated member having a substantially D-shaped cross-section for mounting to the substantially U-shaped channel. The elongated member has a silicone rubber outer core having a substantially D-shaped cross section, and an inner core within the outer substantially D-shaped outer core. The inner core includes an intumescent material. In this aspect, the gasket is mounted in the retainer channel. The arrangement also includes a fireproofed door with a door panel mounted to the door frame, with the gasket contacting the door panel, thereby sealing the doorway when the door is in a closed position.

In another aspect the invention is method of sealing a doorway. The method includes the steps of providing a door frame, and attaching a fireproofed door on the door frame. In this aspect, the method also includes the step of attaching a gasket retainer with a substantially U-shaped groove to the door frame, and mounting a gasket in the substantially U-shaped groove of the retainer. The gasket comprises an elongated member having a substantially D-shaped cross-section for mounting to the gasket retainer in the door frame. The elongated member has an outer core having a substantially D-shaped cross section. The outer core includes a flat back side, two side portions, and a front side. In this aspect, the gasket is provided with an inner core within the substantially D-shaped outer core. The inner core comprises an intumescent material for filling doorway voids during fires. The gasket is inserted into the U-shaped groove with the flat back side of the gasket contacting a back wall of the substantially U-shaped groove, and the front side of the gasket contacting the fireproofed door thereby sealing the doorway when the door is in a closed position.

BRIEF DESCRIPTION OF DRAWING

A more complete appreciation of the invention and many of its attendant advantages will be readily appreciated as the same becomes better understood by reference to the following detailed description when considered in connection with the accompanying drawing wherein:

FIG. 1A is a sectional view of a gasket in accordance with an embodiment of the present invention;

FIG. 1B is a perspective view of a gasket in accordance with an embodiment of the present invention;

FIG. 2A is a perspective view of a sealing arrangement in accordance with an embodiment of the present invention;

FIG. 2B is a sectional view of a sealing arrangement in accordance with an embodiment of the present invention;

DETAILED DESCRIPTION OF PREFERRED EMBODIMENT

Figure 3:
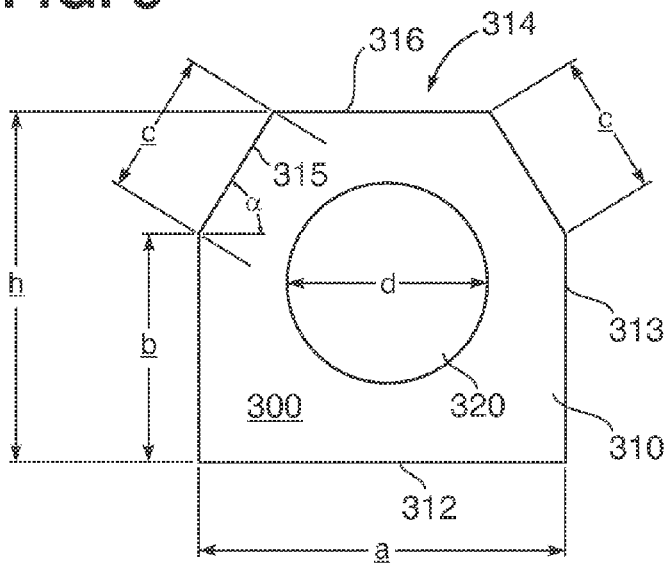
FIG. 3 is a sectional view of a gasket in accordance with another embodiment of the present invention.

FIGS. 1A and 1B illustrate one embodiment of a gasket 100, the gasket device used for sealing a doorway. As shown in FIG. 1A the gasket 100 has a substantially D-shaped cross section. FIG. 1A also shows the gasket 100 having a substantially D-shaped outer core 110, and an inner core 120. The inner core 120 is positioned at a substantially central portion within the D-shaped outer core, and may have a circular cross-section. FIG. 1B is a perspective view of the gasket 100 showing the elongated structure of the device 100. FIGS. 1A and 1B also show the flat back side 112 and the front side 114 of the device 100, which has a curved shape. Side portions 113 are also illustrated.

FIG. 1A also shows possible dimensions for the gasket 100. As shown in FIG. 1A, the flat back side 112 has a length of a. The side portions 113 each have a length of b. The circular cross-section has a diameter of d. As illustrated, the entire gasket 100 has a height measured from the flat back side 112 to the top of the front side 114 of h. The dimensions may vary according to specific applications. According to one embodiment, the flat back side 112 may have a length a of about 0.75 inches and the side portions may each be a length b of about 0.50 inches long. Additionally, the diameter d of the inner core may be about 0.50 inches. The height h of the gasket may be 0.75 inches.

The outer core 110 may be a silicone rubber material, preferably of a Commercial Item Description A-A-59588 type. The A-A-59588 is preferably class 3B, grade 30, but may also be of other A-A-59588 silicone rubber classes and grades. The silicone rubber used for the gasket 100 is more easily manipulated as compared with other silicone rubbers with higher durometer values. The A-A-59588 silicone rubber also has a longer life expectancy and requires less maintenance than most conventionally used silicone rubbers.

The inner core 120 of the present embodiment comprises an intumescent material, which expands upon exposure to escalated temperatures. The intumescent material may comprise any known intumescent chemical, such as intercalated graphite, mica, perlite, vermiculite, hydrated sodium silicate, a phosphorus compound, and combinations thereof. An intumescent material may be chosen depending on the operating conditions and the required amount of expansion.

FIGS. 2A and 2B illustrate a sealing arrangement 200 according to an embodiment of the invention. The arrangement includes a door frame 210 that generally supports the overall structure. A gasket retainer 220 with a substantially U-shaped channel is attached to the door frame 210. Any suitable known attaching means, such as screws, nuts, bolts, or combinations thereof may be used to attach the gasket retainer 220 to the door frame 210. These attaching means also provide the benefit of adjustability. The substantially U-shaped channel includes a first side wall 222, a second side wall 224, and a back wall 226. The side walls 222 and 224 may be parallel to each other. However, in a preferred embodiment, the first wall 222 may be slightly angled towards the second wall 224, which results in the retainer 220 having a somewhat hook-like shape. This improves the seal between the gasket and the gasket retainer.

As shown in FIG. 2A, a fireproofed door 230 is hinged at 215 to the door frame 210, with the door frame 210 surrounding the outer circumference of the door 230. The door 230 may comprise a hollow panel 235 filled with a heat insulating material that reduces heat transfer from one side of the door panel to the other during a fire. The entire arrangement is sealed or fireproofed by introducing the gasket 100 into the gasket retainer 220. As shown in FIG. 2B, the gasket 100 is placed in the U-shaped channel of the retainer 220, so that the flat back side 112 of the gasket is inserted into the U-shaped channel. Consequently, the flat back side 112 of the gasket contacts the back wall 226 of the U-shaped channel. When in this working position, the front portion 114 of the gasket contacts the door 230 forming a sealed relationship.

FIG. 3 is a sectional view of a gasket 300 in accordance with another embodiment of the present invention. The gasket 300 has a substantially D-shaped cross section, and may be used in the arrangement illustrated in FIGS. 2A and 2B. FIG. 3 shows the gasket 300 having a substantially D-shaped outer core 310, and an inner core 320. The inner core 320 is positioned at a substantially central portion within the D-shaped outer core, and may have a circular cross-section. Similar to the embodiment of FIGS. 1A and 1B, the gasket 300 has a flat back side 312 and side portions 313. Gasket 300 also includes a front side 314. The front side 314 of the present embodiment includes two chamfered sides 315 and a flat top surface 316.

FIG. 3 also shows possible dimensions for the gasket 300. As shown in FIG. 3, the flat back side 312 has a length of a. The side portions 313 each have a length of b. The circular cross-section has a diameter of d. As illustrated, the entire gasket 300 has a height h measured from the flat back side 312 to the top of the flat top surface 316 of the front side. The chamfered sides 315 may have a length of c. As shown, the chamfered edges are chamfered at an angle $\alpha$. The dimensions may vary according to specific applications. According to one embodiment, the flat back side 312 may have a length a of about 0.75 inches and the side portions may each be a length b of about 0.50 inches long. Additionally, the diameter d of the inner core may be about 0.50 inches. The height h of the gasket may be 0.75 inches, and each chamfered side may be about 0.25 inches. The chamfered angle $\alpha$ may be at about 30 degree to 45 degrees to the horizontal.

Figure 4:
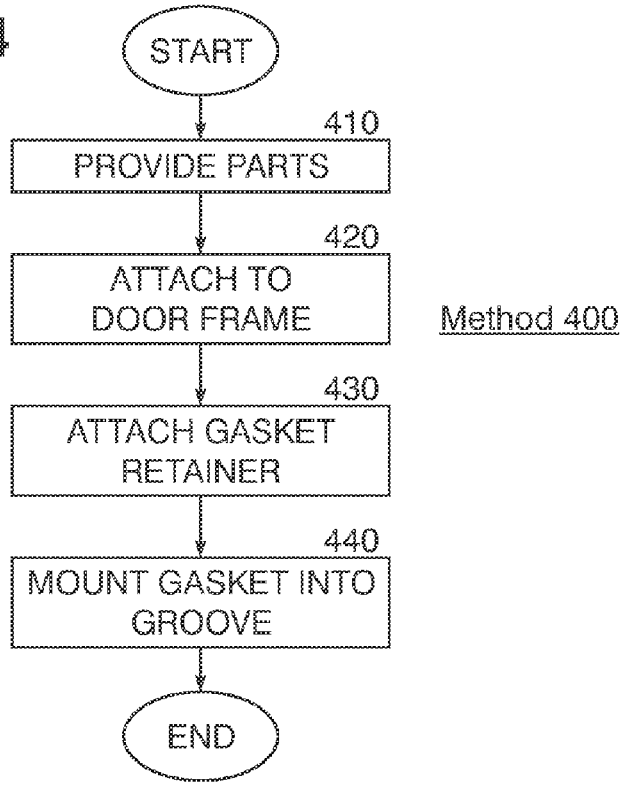
FIG. 4 is a flowchart of a sealing method in accordance with an embodiment of the present invention.

FIG. 4 is a flowchart of a sealing method 400 in accordance with an embodiment of the present invention. The method may be applied using either gasket 100 or gasket 300. At 410, the parts of the sealing arrangement are provided. This includes providing a door frame 210, a door panel 230, a gasket retainer 220, and a gasket (100, 300). At 420, a gasket retainer 220 with a substantially U-shaped channel is attached to the door frame 210. Any suitable known attaching means, such as screws, nuts, bolts, or combinations thereof may be used to attach the gasket retainer 220 to the door frame 210. These attaching means also provide the benefit of adjustability. At 430, a substantially D-shaped gasket (100, 300) is inserted into the gasket retainer 220. The flat back side (112, 312) of the gasket is inserted into the U-shape channel to create a proper mating relationship between the elements. At 440, a door 230 is attached to the door frame 210. Preferably, the door is attached to the door frame by means of a hinge. When the door 230 is closed, the front side (114, 314) of the gasket presses against the door forming a sealed relationship. The method 400 may be performed exclusively in the recited sequence, or alternatively, may be performed out of sequence.

The method and apparatus as outlined above, is geared towards preventing the spread of fire and smoke through doorways. The overall shape including the protruding front ends (114, 314), the dimensions, and material characteristics such as compressibility of the gaskets (100, 300), improve the ability to seal. As outlined above, the gaskets (100, 300) are positioned with the front sides (114, 314) pressed against the door 230 to provide a sealed airtight relationship with the door 230. When there is a fire, the gaskets (100, 300) are able to withstand tremendous heat for shortened periods of time. This is mainly due to the outer layer which is formed of A-A-59588 silicone rubber, Class 3B, Grade 30. However, if the gasket 100 is exposed to fire for a prolonged period, the outer core may eventually char and expose the inner to higher temperatures. The inherent properties of the intumescent inner core will result in the expansion of the inner core of about twenty to about forty times its original volume. This voluminous expansion of the inner core will fill up any voids left by the deterioration of the silicone rubber outer core, retaining the fumetight seal.

What has been described and illustrated herein are preferred embodiments of the invention along with some variations. The terms, descriptions and figures used herein are set forth by way of illustration only and are not meant as limitations. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A fumetight gasket for use in a doorway, the gasket comprising:

an elongated member having a substantially D-shaped cross-section mountable to a substantially U-shaped gasket retainer of a door frame, the elongated member having:

a substantially D-shaped outer core comprising silicone rubber; and an inner core within the substantially D-shaped outer core, the inner core comprising an intumescent material having an expansivity that allows the intumescent material to expand and exit the inner core of intumescent material to fill doorway voids left by the deterioration of the outer core during fires, when the inner core is exposed by the deterioration of the outer core, wherein the inner core of intumescent material is located at a substantially central portion within the D-shaped outer core, the inner core of intumescent material having a circular cross section, and wherein the front side is a curved side, the curved side being formed substantially symmetrical with the circular inner core section, wherein the substantially D-shaped outer core comprises:

a flat back side for contacting a back wall of the substantially U-shaped gasket retainer;

two side portions for contacting side walls of the substantially U-shaped gasket retainer; and a front side protruding to make contact with a door panel under pre-fire conditions when the door panel is in a closed position, and wherein the ratio of a diameter of the inner core of intumescent material, to a length of the flat back side is about 2:3, and the ratio of the diameter of the inner core of intumescent material, to a height from the flat back side to the top of the front side is about 2:3.

2. The fumetight gasket of claim 1, wherein the silicone rubber is selected from a class in accordance with Commercial Item Description A-A-59588, Class 3B Grade 30.

3. The fumetight gasket of claim 2, wherein a height from the flat back side to the top of the front side is about 0.75 inches, the flat back side is about 0.75 inches long, the side portions are each about 0.50 inches long, the inner core has a diameter of about 0.50 inches.

4. The fumetight gasket of claim 3, wherein the intumescent material of the inner core comprises a material selected from the group comprising graphite, mica, perlite, vermiculite, hydrated sodium silicate, phosphorus, and combinations thereof to allow for up to 4000% expansion of the intumescent material if the intumescent section is exposed when the silicone rubber outer core deteriorates due to exposure to fire.

5. The fumetight gasket of claim 1, wherein the front side comprises a flat top portion and two chamfered portions.

6. The fumetight gasket of claim 5, wherein the chamfered portions are about 0.25 inches long and form an angle of about 30 degrees to about 45 degrees with the flat top portion.

7. A fire zone doorway arrangement having:

a door frame;

a gasket retainer attached to the door frame, the gasket retainer having a substantially U-shaped channel with a back wall, a first side wall, and a second side wall, wherein the first side wall is angled towards the second side wall, thereby providing the U-shaped channel with a hook-like shape;

a gasket comprising an elongated member having a substantially D-shaped cross-section for mounting to the substantially U-shaped channel, the elongated member having:

a silicone rubber outer core having a substantially D-shaped cross section; and an inner core within the outer substantially D-shaped outer core, the inner core comprising an intumescent material having an expansivity that allows the intumescent material to expand and exit the inner core to fill doorway voids left by the deterioration of the outer core during fires when the inner core of intumescent material is exposed by the deterioration of the outer core, wherein the inner core of intumescent material is located at a substantially central portion within the D-shaped outer core, the inner core of intumescent material having a circular cross section, and wherein the front side is a curved side, the curved side being formed substantially symmetrical with the circular inner core section, wherein the gasket is mounted in the retainer channel; and a fireproofed door with a door panel mounted to the door frame, the gasket contacting the door panel, thereby sealing the doorway when the door is in a closed position, wherein the substantially D-shaped outer core comprises:

a flat back side contacting the back wall of the retainer channel;

two side portions contacting the two oppositely positioned side walls of the retainer channel; and, a front side contacting the door panel in pre-fire conditions when the door panel is in a closed position, and wherein the ratio of a diameter of the inner core of intumescent material, to a length of the flat back side is about 2:3, and the ratio of the diameter of the inner core of intumescent material, to a height from the flat back side to the top of the front side is about 2:3.

8. The fire zone doorway arrangement of claim 7, wherein the silicone rubber is selected from a class in accordance with Commercial Item Description A-A-59588, Class 3B Grade 30.

9. The fire zone doorway arrangement of claim 8, wherein a height from the flat back side to the top of the front side is about 0.75 inches, the flat back side is about 0.75 inches long, the side portions are each about 0.50 inches long, and the inner core has a diameter of about 0.50 inches.

10. The fire zone doorway arrangement of claim 7, wherein the front side of the substantially D-shaped outer core comprises a flat top portion and two chamfered portions.

11. The fire zone doorway arrangement of claim 10, wherein the chamfered portions are about 0.25 inches long and form an angle of about 30 degrees to about 45 degrees with the flat top portion.

12. A method of sealing a doorway, the method comprising:

providing a door frame;

attaching a fireproofed door on the door frame;

attaching a gasket retainer with a substantially U-shaped groove to the door frame;

mounting a gasket in the substantially U-shaped groove of the retainer, wherein the gasket comprises an elongated member having a substantially D-shaped cross-section for mounting to the gasket retainer in the door frame, the elongated member having:

an outer core having a substantially D-shaped cross section, comprising a flat back side, two side portions, and a front side; and an inner core within the substantially D-shaped outer core comprising an intumescent material, wherein the intumescent material is provided with an expansivity so that during fires when the inner core of intumescent material is exposed by the deterioration of the outer core, the intumescent material expands and fills doorway voids left by the deterioration of the outer core, wherein the inner core of intumescent material is located at a substantially central portion within the D-shaped outer core, the inner core of intumescent material having a circular cross section, and wherein the front side is a curved side, the curved side being formed substantially symmetrical with the circular inner core section, wherein the ratio of a diameter of the inner core of intumescent material, to a length of the flat back side is about 2:3, and the ratio of the diameter of the inner core of intumescent material, to a height from the flat back side to the top of the front side is about 2:3.

13. The method of claim 12, wherein the silicone rubber is selected from a class in accordance with Commercial Item Description A-A-59588, Class 3B Grade 30, and wherein the inner core is provided at a substantially central portion within the D-shaped outer core and the intumescent material of the inner core is selected from the group comprising graphite, mica, perlite, vermiculite, hydrated sodium silicate, phosphorus, and combinations thereof to allow for up to 4000% expansion of the intumescent material if the intumescent section is exposed when the silicone rubber outer core deteriorates due to exposure to fire.

14. The method of claim 12, wherein in the mounting of the gasket, the gasket is inserted into the U-shaped groove, with the flat back side of the gasket contacting a back wall of the substantially U-shaped groove, and the front side of the gasket contacting the fireproofed door thereby sealing the doorway in pre-fire conditions when the door is in a closed position.

* * * * *